US007219372B2

(12) United States Patent
Frieler et al.

(10) Patent No.: US 7,219,372 B2
(45) Date of Patent: May 22, 2007

(54) KNEEPAD

(76) Inventors: Craig Frieler, 315 43rd Street Blvd., NE., Bradenton, FL (US) 34208; Athena Frieler, 315 43rd Street Blvd., NE., Bradenton, FL (US) 34208

( * ) Notice: Subject to any disclaimer, the term of this patent is extended or adjusted under 35 U.S.C. 154(b) by 33 days.

(21) Appl. No.: 11/128,609

(22) Filed: May 12, 2005

(65) Prior Publication Data

US 2005/0268370 A1 Dec. 8, 2005

Related U.S. Application Data

(60) Provisional application No. 60/572,917, filed on May 20, 2004.

(51) Int. Cl.
*A41D 13/00* (2006.01)

(52) U.S. Cl. ..... 2/23

(58) Field of Classification Search ..... 2/22, 2/23, 16, 24, 455, 69, 456, 80, 79, 227, 62
See application file for complete search history.

(56) References Cited

U.S. PATENT DOCUMENTS 3,257,666 A * 6/1966 Hoffman ..... 2/459
4,561,123 A * 12/1985 Hull ..... 2/23
5,592,689 A * 1/1997 Matthews ..... 2/23
5,732,412 A 3/1998 Holden ..... 2/23
5,742,939 A * 4/1998 Williams ..... 2/69
5,920,902 A 7/1999 Crampton ..... 2/24

* cited by examiner

*Primary Examiner*—Tejash Patel
(74) *Attorney, Agent, or Firm*—Gifford, Krass, Groh, Sprinkle, Anderson & Citkowski, P.C.

(57) ABSTRACT

A protective kneepad for detachable attachment to an attaching portion mounted on the exterior of the workman's pants in which the kneepad is larger lengthwise of the pants that the attaching portion for a range of adjustment both longitudinally and laterally greater than the dimensions of the detaching portion. The kneepad is detachable from the work pants allowing ease of movement and laundry of the work pants without any interference from the kneepad. The method of attachment of the system to the pants of a workman is simple and requires no special skills. Adhesion of the attaching portion to the workpants is enhanced by the application of heat.

9 Claims, 2 Drawing Sheets

KNEEPAD

REFERENCE TO RELATED APPLICATION

This application claims priority from U.S. Provisional Patent Application Ser. No. 60/572,917 filed May 20, 2004, the content of which is incorporated herein by reference.

FIELD OF THE INVENTION

This invention relates to protective kneepads and particularly the apparatus and method of detachably and adjustably attaching the kneepads to work pants.

BACKGROUND OF THE INVENTION

Kneepads are frequently used by workman who perform their tasks in a kneeling position such as the laying of tile or carpeting and roofing or by gardeners. After prolong periods of time the knees become sore and cause discomfort. Kneepads, which are conventionally used typically, fall into two categories, that is, those held in position by straps and those that are held in pockets sewn or cemented to work pants. In both types of arrangement, position of the work pads to the knee is predetermined and no provision is made for adjustment of the pad relative to the knee. The typical objections to strap on type of knee pads is that they cause discomfort after a long periods of wear and the attachment and detachment can be time consuming and lengthy. The objections to kneepads, which are attached to the work pants in pockets holding the pad, is that on the pocket or the pant leg are subject to wear and abrasion during use of the kneepad and that most such systems are a permanent attachment of the kneepad to the pants which makes them uncomfortable when walking and more difficult to launder. Also the installation of kneepads on work pants requires some skills relative to positioning and attachment of the pads.

SUMMARY OF THE INVENTION

There appears to be a need for a kneepad used in association with work pants which is easily detachable when not in use, which is adjustable relative to the knee to accommodate different work environment or conditions, in which the wear is absorbed on the pad and not on the pant or pocket surface. Also, there is a need for a kneepad, which is easily installed on work pants without the need of special skills or tools.

These requirements are met by the present invention in which the kneepad is an elongated piece of foam having a hook attaching portion of a hook and loop attaching system the hook portion is slightly narrower than the kneepad and extends centrally for the full length of the kneepad. The attaching portion of the kneepad is attachable to a loop portion which is fixed to the users work pants. The loop portion preferably is a square having each of its sides equal to the width of the kneepad. The arrangement of sizes is such that the elongated kneepad can be adjusted over a relatively large range relative to the attaching portions on each knee of the pants with the kneepads extending longitudinally or transversely of the pant legs. The kneepads can be removed when not in used to give the workers freedom of movement or to permit laundering of the pants without encumbrance of the kneepad.

The method by which the kneepad system is installed on a pair of work pants is simple and requires no special tools other than a readily available electric pressing iron. The user dons the pants and marks the knee position on the pants. With the pants removed, the loop attaching portion is placed in a predetermined position relative to the mark. Thereafter heat is applied with the pressing iron to fuse the adhesive and pant material to make a reliable attachment.

DETAILED DESCRIPTION

Figure 1:
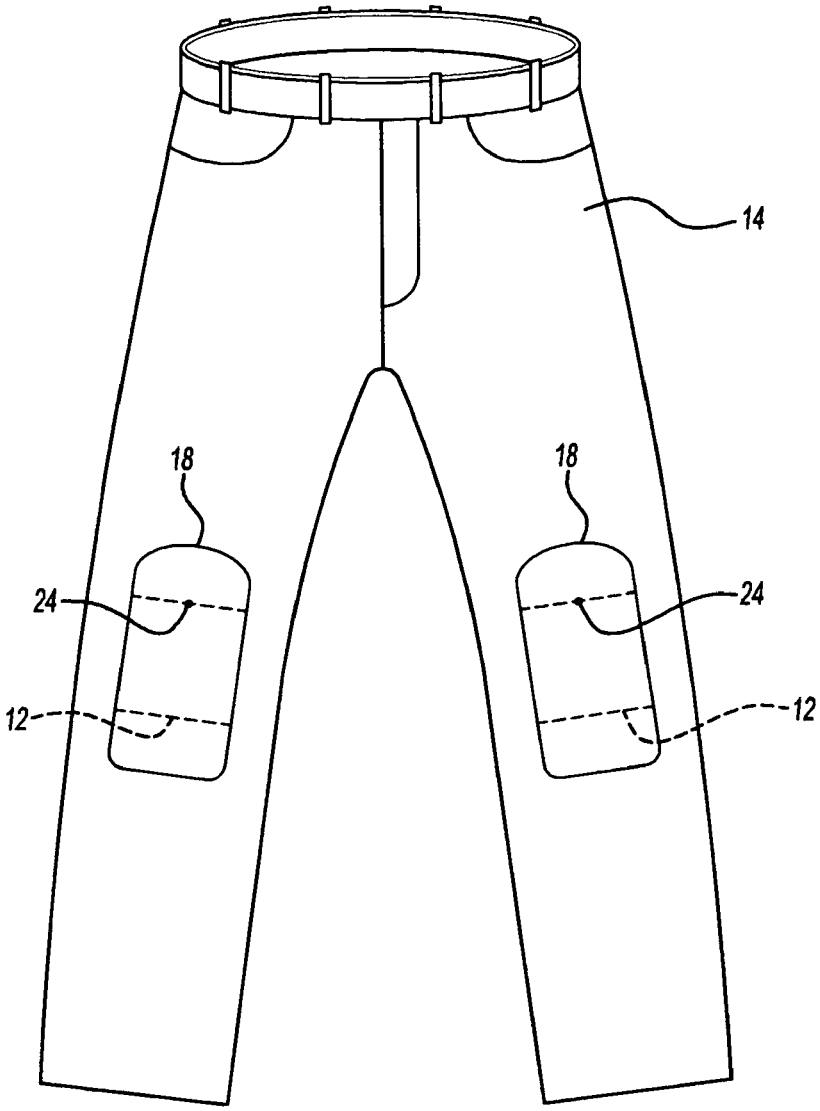
FIG. 1 is a frontal view of a pair of pants with the kneepads embodying the invention installed thereon.
Figure 2:
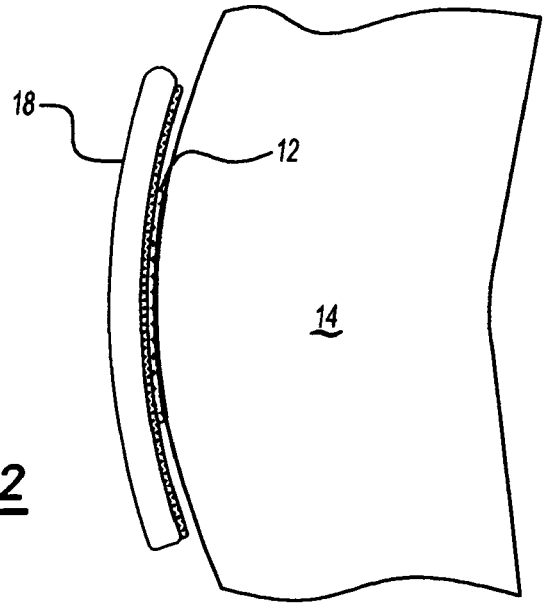
FIG. 2 is a side elevation at an enlarged scale of a portion of the pants and kneepad seen in FIG. 1.

The kneepad apparatus of the present invention is designated generally at 10 and utilizes a hook and loop attaching system in which the attaching member 12 with a loop portion 13 is applied to the work pants 14 in a fixed position and in which the complementary hook portion 16 is attached to the back surface of a foam kneepad 18. The fastener system of hook 16 and loop 13 is industrial grade automotive type and has a backside provided with an adhesive which is covered with a releasable protective paper. Removal of the paper activates the adhesive which becomes fully cured in about forty-eight hours. The loop and hook material with adhesive backing is obtainable from Velcro USA, Inc. 406 Brown Avenue, Manchester, N.H.

In a preferred embodiment of the invention the kneepad 18 is made of a closed cell foam or other cushioning material. In an actual embodiment the closed cell foam was Ensolite IV3 obtained from Rubberlite Incorporated of Huntington, W.Va.

Figure 3:
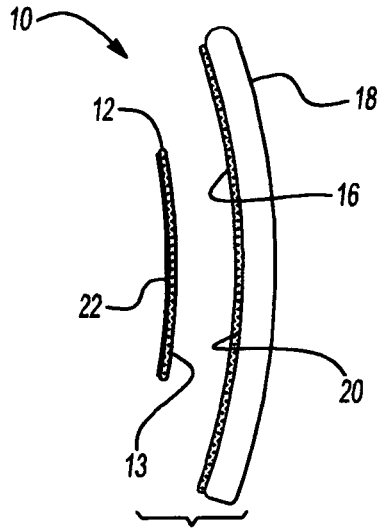
FIG. 3 is an exploded view of the kneepad and attaching system employed in the present invention.
Figure 4:
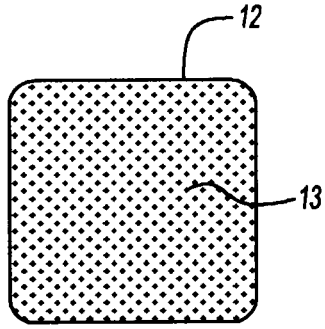
FIG. 4 is a front view of the loop attaching portion of the attaching system which attaches to the pants.
Figure 5:
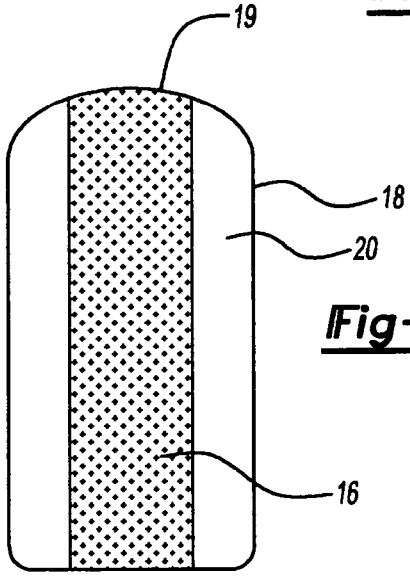
FIG. 5 is a rear view of the kneepad with the hook attaching portion fastened to the back side.

The kneepad 18 can have a generally rectangular configuration with the dimensions of about eight inches long and four inches wide and one-half inch thick. One end of the kneepad 18 can be curved slightly as indicated at 19 and the hook-connecting portion 16 extends the full length of the kneepad 18 but need be only about two inches wide. The hook portion 16 is applied to the foam kneepad 18 by removing the paper covering to expose the adhesive on the back of the hook portion 16. The hook portion 16 is positioned to extend centrally and longitudinally of the pad. The kneepad 18 can be slightly curved longitudinally as seen in FIG. 3, in which case the hook-connecting portion 16 is fastened to the concave or backside 20 of the pad. To insure good adhesion, the hook portion 16 is pressed into tight engagement with the kneepad 18 and after forty-eight hours the adhesive is regarded as fully cured. However, it has been found that a faster and more secure attachment can be achieved by applying heat with hot air.

The attaching member 12 with loop portion 13 of the fastening system which is attached to the pants 14 can be a square of about four by four inches. The attaching member 12 is provided with adhesive on the back side 12 which serves to make the attaching portion 12 adhere to the exterior of the work pants 14 in a selected position as will be pointed out later. With the attaching member 12 with loop portion 13 attached to the pants and without the kneepad 18, the exposed loops are less likely to pick up unwanted materials than if the hook portion 16 was used.

Figure 6:
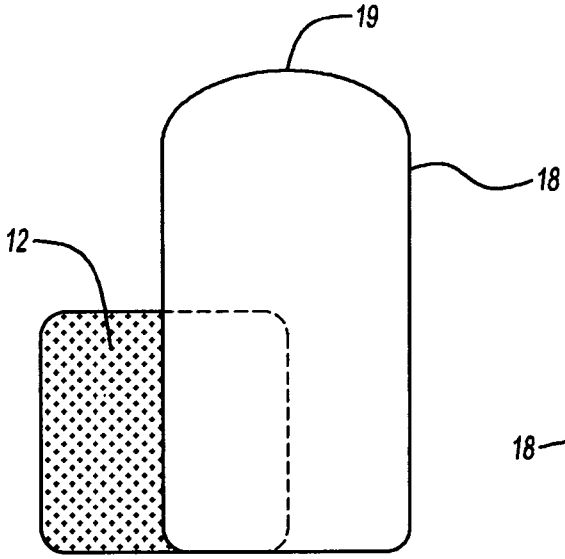
FIG. 6 is a front view of the kneepad illustrating the range of adjustment relative to the attaching portion fastened to the pants.
Figure 7:
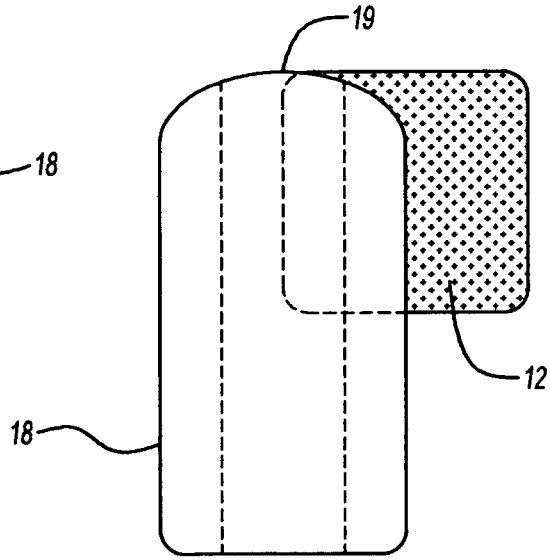
FIG. 7 is a view similar to FIG. 6 showing another possible adjustment of the kneepad.

Once attached, the patch or attaching member 12 forms a fixed attaching portion on the exterior of the pants 14 so that the longitudinal foam pad 18 may be placed in selected positions to extend longitudinally of the users leg. Assuming that the hook and loop system 13, 16 should maintain an area of four square inches in contact with each other, the arrangement affords a range of longitudinal and transverse adjustment that is illustrated in FIGS. 6 and 7. In FIG. 6, the kneepad 18 has been positioned to extend about four inches above the attaching member 12 and in FIG. 7 the kneepad extends four inches below the attaching member 12. This results in a range of adjustment of the kneepad longitudinally of twelve inches. A transverse adjustment of six inches is available with the same area of fastener contact as illustrated in FIGS. 6 and 7. In FIG. 6 the pad 18 is positioned to one side of the loop fastener portion 12 and in FIG. 7 a similar adjustment is made to the opposite side. This gives a range of six-inch adjustment transversely. In actual practice, if a lesser area of contact between loop and hook fastener is found to be suitable, the adjustment range can become greater.

Under some special conditions it may be desirable to place the elongated kneepad 18 to extend transversely of the pant leg rather than longitudinally. Under such conditions a similar range of adjustment is available transversely as when the kneepad extends longitudinally of the pant leg.

The wide range of adjustment of the kneepad 18 relative to the attaching member is useful in accommodating different conditions or positions in which the kneepad can protect the users legs. For example, with a painter on a rung of a ladder, the kneepad can be placed in a depending position as illustrated in FIG. 7 to protect or cushion the legs relative to the ladder rung above the one on which the painter is standing.

Removal of the kneepad 18 from the work pants is accomplished by grasping a portion, for example, the top portion of the kneepad and pulling it from the attaching member 12 on the pants.

The kit by which the kneepad system is made available to a user contains a complete set of materials and instructions to make the installation. The materials include a pair or patches of loop connectors 12 with adhesive on the backside, which is protected by a releasable paper. The kit also includes a pair of foam kneepads 18 with the hook connector portion 16 already applied to extend longitudinally of the kneepad.

The method by which the kneepad system is installed by the user begins by dressing in a pair of work pants 14 with which the system is to be used. While in a sitting position, with the knees approximating a kneeling position, the user marks the outer portion of the pants at the top and center of each of the kneecaps as indicated at 24 in FIG. 1 with a marker or chalk.

With the paper removed from the adhesive on the back of the square attaching member or patch 12, the patch is placed so that the central portion of the top edge is in alignment with the marks 24 made on the outside of the work pants. The adhesive on the back of the patch 12 is such that it will operate to hold the patch in position temporarily. With the user dressed in the pants the patch 12 with the loop connectors can be readjusted if necessary. Thereafter the pants 14 are removed and placed on a work surface with the loop portion 13 of member 12 facing downward. Thereafter, a conventional electrically heated iron can be used to apply heat to the back side of the pant legs in the area of the patch so that heat is transmitted through two layers of pant leg to soften the adhesive and insure that it bonds with the fabric of the pants. This acts to fuse the loop attaching portion 12 with the pant materials and make for a more permanent connection. A relatively high heat such as that used for cotton fabrics is applied for three or more minutes depending on the pant material. As soon as the material in the pants cool the adhesive can be regarded as fully cured.

In the event the loop attaching portion 13 is damaged so that replacement becomes desirable, the attaching portion 12 can be removed by applying heat with an iron to soften the adhesive. This allows the attaching portion 12 to be removed and replaced.

With the attaching member 12 with the loop attaching portion 13 installed on the pants 14, the pant legs remain relatively flexible and do not interfere with leg movement or use. Also, since the kneepads 18 can be easily detached, the pants 14 can be laundered without the need to launder the kneepad. Also, without the kneepad 18 attached the only encumbrance from normal leg movement is the addition of a relatively flexible and light attaching member 12. Although the attaching members or patches 12 may be visible they are not unsightly and are not as obvious as pockets with pads in the pockets.

A kneepad system has been provided in which the pad is not only easily removable and attached but also is adjustable to various positions to accommodate the conditions under which the kneepads are used. The method of installation is simplified and requires only a heating iron, which would be readily available.

The invention claimed is:

1. A kneepad supported on the exterior of pants worn by the user, comprising:

an attaching member fastened to a exterior knee location on the leg of a pair of pants and having a predetermined width and height;

a protective pad of resilient foam material having a width substantially equal to that of said attaching member and a length greater than the height of said attaching member;

fastening means having a loop portion and a hook portion detachably attachable to each other, one of said portions covering the entire surface of said attaching member and the other of said portions covering an area less than the width of said attaching member and extending for the full length of said protective pad wherein said portions of said fastening means have a maximum common contact area with each other less than the area of said attaching member, said pad being moveable to selected positions relative to said attaching member and simultaneously maintaining said common contact area in a range greater than the width of said attaching member and in the range longitudinally of more than the height of said attaching member.

2. The kneepad of claim 1 wherein the fastening portion on said protective pad is substantially one half of the width of said protective pad and extends centrally for the full length of said pad.

3. The kneepad of claim 2 wherein said kneepad extending vertically is adjustable in a range of one half the width of said attaching portion to either side of said attaching portion and in a range longitudinally of one half of the length of said protective pad above and below said attaching portion.

4. The kneepad of claim 1 wherein said loop portion of said fastening means is disposed on the surface of said attaching portion.

5. The kneepad of claim 1 wherein the perimeter of said attaching portion is square and the perimeter of said protective pad is substantially rectangular.

6. The kneepad of claim 1 wherein said loop portion and hook portion are fastened to said attaching member and to said protective pad with adhesive.

7. The kneepad of claim 1 wherein said hook portion is fastened to said protective pad.

8. The kneepad of claim 6 wherein said adhesive is cured using heat.

9. The kneepad of claim 1 wherein said protective pad is made of closed cell foam.

* * * * *